US010890012B2

(12) United States Patent
Ramsay

(10) Patent No.: US 10,890,012 B2
(45) Date of Patent: Jan. 12, 2021

(54) LOCK AND KEY THEREFOR

(71) Applicant: Integrated Lock Systems Australia Pty Ltd, West End (AU)

(72) Inventor: George Ramsay, West End (AU)

(73) Assignee: Integrated Lock Systems Australia Pty Ltd, West End (AU)

( * ) Notice: Subject to any disclaimer, the term of this patent is extended or adjusted under 35 U.S.C. 154(b) by 0 days.

(21) Appl. No.: 16/616,543

(22) PCT Filed: Jun. 1, 2018

(86) PCT No.: PCT/AU2018/050537
§ 371 (c)(1),
(2) Date: Nov. 25, 2019

(87) PCT Pub. No.: WO2018/218301
PCT Pub. Date: Dec. 6, 2018

(65) Prior Publication Data

US 2020/0378151 A1 Dec. 3, 2020

(30) Foreign Application Priority Data

Jun. 2, 2017 (AU) ..... 2017203748

(51) Int. Cl.
*E05B 27/00* (2006.01)
*E05B 29/00* (2006.01)

(52) U.S. Cl.
CPC ..... *E05B 27/0082* (2013.01); *E05B 27/0042* (2013.01); *E05B 27/0057* (2013.01);
(Continued)

(58) Field of Classification Search
CPC .. E05B 15/14; E05B 27/0017; E05B 27/0039; E05B 27/0042; E05B 27/0057;
(Continued)

(56) References Cited

U.S. PATENT DOCUMENTS 2,182,588 A * 12/1939 Jacobi ..... E05B 29/0013 70/366
2,563,215 A * 8/1951 Crumb ..... E05B 29/0013 70/366

(Continued)

FOREIGN PATENT DOCUMENTS

DE 3145063 A1 5/1983
DK 162356 B 10/1991

(Continued)

*Primary Examiner* — Christopher J Boswell
(74) *Attorney, Agent, or Firm* — David A. Guerra

(57) ABSTRACT

A lock cylinder having a barrel and a lock housing, the barrel having a locking cam pivotally mounted therein, the locking cam including at least one recess on an outer periphery thereof, a housing recess formed on an inner wall of the lock housing, a locking member that, in a locking position, is positioned at least partly in the housing recess formed on the inner wall of the lock housing, the at least one recess on the locking cam including a first recess on the locking cam, the first recess being sized to enable the locking member to move out of the housing groove, the barrel having a key slot for receiving a key, the key including a projection for causing the locking cam to rotate to bring the first recess on the locking cam adjacent to or into alignment with the locking member such that the locking member moves out of the housing recess and into the first recess of the locking cam and barrel slot to thereby enable rotation of the barrel in the lock housing.

20 Claims, 2 Drawing Sheets

(52) U.S. Cl.
CPC ..... *E05B 29/0066* (2013.01); *E05B 27/0017* (2013.01); *E05B 27/0039* (2013.01)

(58) Field of Classification Search
CPC ..... E05B 27/0082; E05B 29/0013; E05B 29/002; E05B 29/0066
See application file for complete search history.

(56) References Cited

U.S. PATENT DOCUMENTS 2,578,211 A * 12/1951 Spain ..... E05B 29/0013 70/366
2,648,973 A * 8/1953 Spain ..... E05B 29/0013 70/366
2,729,092 A * 1/1956 Taylor ..... E05B 29/00 70/495
3,709,006 A * 1/1973 Seidewand ..... E05B 29/00 70/495
4,638,651 A 1/1987 Surko, Jr.
4,753,091 A * 6/1988 Sheets ..... E05B 31/00 70/419
5,293,764 A * 3/1994 Guzzinati ..... E05B 29/002 70/365
6,490,898 B1 * 12/2002 Mottura ..... E05B 27/0039 70/495
8,695,390 B2 * 4/2014 Ng ..... E05B 29/00 70/492
2002/0056301 A1 5/2002 Theriault et al.

FOREIGN PATENT DOCUMENTS

DK 410786 A 10/1991
JP 2005213807 A 8/2005
WO 2016179631 A1 11/2016

* cited by examiner

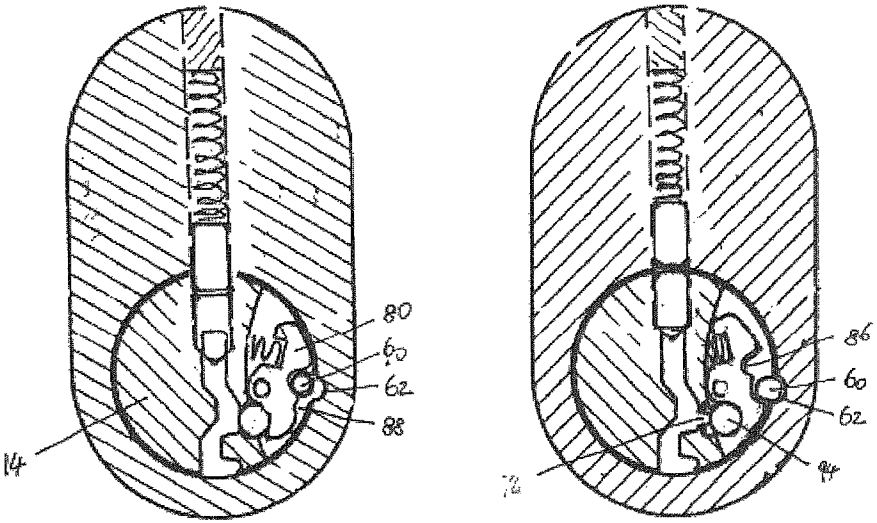
Fig 6
Fig 7
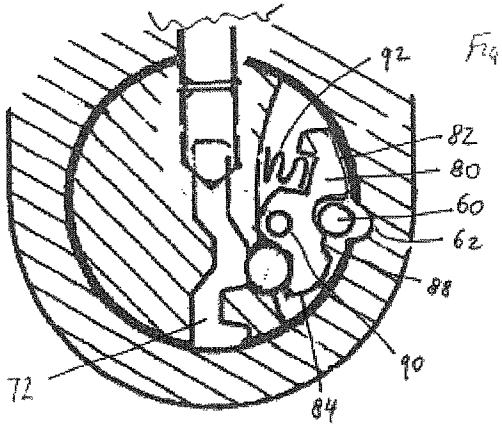
Fig 8

LOCK AND KEY THEREFOR

CROSS-REFERENCE TO RELATED APPLICATIONS

This application is an U.S. national phase application under 35 U.S.C. § 371 based upon co-pending International Application No. PCT/AU2018/050537 filed on Jun. 1, 2018. Additionally, this U.S. national phase application claims the benefit of priority of co-pending International Application No. PCT/AU2018/050537 filed on Jun. 1, 2018 and Australia Application No. 2017203748 filed on Jun. 2, 2017. The entire disclosures of the prior applications are incorporated herein by reference. The international application was published on Dec. 6, 2018 under Publication No. WO 2018/218301 A1.

TECHNICAL FIELD

The present invention relates to an improved lock and key for use in the improved lock. In some embodiments, the present invention relates to a pin tumbler lock and to a key for use in a pin tumbler lock. The lock of the present invention has enhanced security features compared to conventional locks.

BACKGROUND ART

Pin tumbler locks are widely used in Australia and in other countries. Pin tumbler locks typically have a cylinder assembly that includes a rotatable core or plug or barrel. The cylinder assembly includes a housing into which the core or plug or barrel is positioned. In some locks, such as padlocks, the housing also forms the body of the lock.

The rotatable barrel and the housing have a series of bores formed therein. When the lock is in the locked condition, the bores in the housing are in alignment with the respective bores in the barrel. Each of the aligned bores carries a barrel pin and a housing pin. The barrel pin and the housing pin contact each other at a shear point or a junction point. Springs are used to bias the pins towards the barrel. A key slot is formed in the barrel for the key entry. Insertion of a key having the correct notches or bits aligns the shear point of each set of the housing pins and barrel pins with the rotational part of the barrel in the housing. Thus, insertion of the key allows the barrel to rotate in the housing and this allows the locking mechanism to function. When the key is withdrawn, the shear point between at least one set of housing pins and barrel pins moves so that it is located away from the turning diameter of the barrel. This prevents rotation of the barrel. Similarly, when an incorrect key is inserted, the shear point between at least one set of housing pins and barrel pins is not coincident with the turning diameter of the barrel, thereby preventing rotation of the barrel.

Pin and tumbler locks may have a plurality of pins, with pin and tumbler locks frequently been provided with five or six sets of barrel and housing pins. However, other numbers of pins may be used. As the number of sets of the barrel and housing pins decreases, the number of possible key combinations that can be set also decreases, thereby reducing security of the lock. Lock manufacturers and locksmiths provide such locks as part of a locking product with two or more keys for the owner of the lock to secure their property. The locks can be supplied as individual units, deemed "keyed to differ" or in lots of two or more in which a single key will open two or more locks, deemed to be "keyed alike."

Lock manufacturers and locksmiths also build and produce a group of locks for a customer with series of keys to accommodate the specific needs of the owner and this is normally referred to as a system or master key system. A system or master key system can have a series of levels or groups of keys that can operate the mechanism of the various designated locks within the system. For example, in a unit complex having a number of different units occupied by different occupants, each occupant may have a key that only opens the lock to their unit. However, the superintendent of the unit complex may have a master key that opens all of the locks to each unit. In this manner, in emergency situations, emergency services or the superintendent can open the door to each unit. This also allows the superintendent to open a specific door in the event that an occupant locks himself or herself out of their unit. A system or master key system can normally be designed and manufactured to suit most types of locks that the customer requests.

Manufacturers and locksmiths also build lock systems and special cylinders and barrels that have intellectual property protection on the parts of the cylinder, barrels and/or keys. These systems are normally deemed "restricted systems." As mentioned above, the barrel of the lock cylinder is traditionally broached with an aperture that is commonly termed the keyhole or keyslot to accommodate the specific and unique profile shape of the key that is milled with the required specific shape or profile to be identical to the broaching made in the barrel. In this manner, the key can be accommodated in the barrel with a precision fit. This key shape or design and barrel broaching may also have intellectual property protection.

When a manufacturer or locksmith builds a lock system for a customer, that system will normally be assigned a system number and all lock cylinders and keys produced for the system will normally have the system number permanently stamped or marked on each cylinder and each key. Keys might also be stamped with markings to identify the level of hierarchy or groups of locks that key will function within the system. Keys that are part of a restricted system are traditionally stamped with a sequential issue number to provide the system owner with the means for controlling and recording all keys issued to key holders for their restricted locking system.

One particular key profile that is proven to be very popular in the United States and Australia is the C4 key profile. Manufacturers of various lock brands and products have realised that it is a key profile that is used and desired by the public and locksmiths for keying other products to the same profile as part of that key system. The C4 key profile has now become the benchmark key profile for most standard lock products produced in five and six pin cylinder format for non-restricted lock systems for the Australian market.

The cuts in the standard key (the valley) that will function the lock cylinder is termed the "bitting." The depth variation of individual bittings in the key is normally about 9 or 10 incremental depths. The depth of individual cuts in the key is designed to match the small precision parts or pin links that are incorporated into the lock system when it is assembled. The possible combination of individual keys for a conventional standard five pin cylinder lock is in excess of 25,000 and a 6 pin cylinder lock has more than 100,000 possible individual key combinations.

Australian patent number 666369 in the name of Master Locksmiths Association of Australasia Limited relates to a key actuated pin and tumbler lock having enhanced security. This lock includes a cylindrical core/barrel that is rotatable in a lock housing via a rotational path, a plurality of pin tumblers received in bores in the core/barrel and lock housing, each bore containing a set of pin tumblers comprising one core pin and one housing pin biased towards the core and having a pin junction therebetween and a key slot in the core. The key is provided with suitable bits to enable the pin junctions to align with the rotational path of the core in the lock housing to permit the core to rotate within the housing. The lock also comprises a retaining mechanism in the form of a spring that is biased to engage at least one of the pin tumblers and to resist movement of the engaged pin tumbler in either direction in its respective bore until released by insertion of a proper key. In the specific embodiment disclosed in this Australian patent, a spring has a movable end that comes into contact with a core pin or a housing pin. If a normal key is inserted, the spring remains in contact with the pin and the spring prevents the pin from moving. If a special key having a lateral wing is inserted into the key slot, the wing causes a ball to move and disengage the end of the spring with the pin. This allows the pins to move to the junction point which, in turn, allows the lock to be operated.

Other types of locks used in Australia include locks that have a number of rotating discs. Each disc has a concave recess formed in it. When a proper key is inserted into the key slot, the discs rotate such that the concave recesses of each disc come into alignment. A locking pin can then drop into the aligned recesses to enable actuation of the lock.

It will be clearly understood that, if a prior art publication is referred to herein, this reference does not constitute an admission that the publication forms part of the common general knowledge in the art in Australia or in any other country.

SUMMARY OF INVENTION

The present invention is directed to a pin and tumbler lock which provides for enhanced security compared to a conventional pin in tumbler lock.

With the foregoing in view, the present invention in one form, resides broadly in a lock cylinder having a barrel and a lock housing, the barrel having a locking cam pivotally mounted therein, the locking cam including at least one recess on an outer periphery thereof, a housing recess formed on an inner wall of the lock housing, a locking member that, in a locking position, is positioned at least partly in the housing recess formed on the inner wall of the lock housing, the at least one recess on the locking cam including a first recess on the locking cam, the first recess being sized to enable the locking member to move out of the housing groove, the barrel having a key slot for receiving a key, the key including a projection for causing the locking cam to rotate to bring the first recess on the locking cam adjacent to or into alignment with the locking member such that the locking member moves out of the housing recess and into the first recess of the locking cam to thereby enable rotation of the barrel in the lock housing.

In one embodiment, the projection may comprise a lateral projection or a wing on the key.

In one embodiment, the locking cam comprises the first recess and a second recess that is shallower than the first recess. In this manner, the second recess is sized to only partly receive the locking member. In other words, the second recess is smaller in cross-section than a cross section of the locking member. In one embodiment, the first recess and the second recess merge into each other. In one embodiment, both the first recess and the second recess are recessed from an outer periphery of the locking cam.

In one embodiment, the lock cylinder comprises a plurality of locking cams.

In one embodiment, the locking cam is pivotally mounted in the barrel, with the locking cam being mounted about a pivot point. The locking cam may include an opening or a hole through which a mounting pin extends such that the locking cam pivots about the mounting pin.

By having the locking cam being pivotally mounted in the barrel, the locking cam is securely held in position and will be unlikely to become misaligned or stuck in use.

In one embodiment, the locking cam is biased towards a locking position. In one embodiment, a biasing means is located between the locking cam and an inner part of the barrel. The biasing means may comprise a compression spring.

In one embodiment, the first recess is larger than the second recess on the locking cam and the first recess is located below the second recess. Throughout this specification, the terms “above”, “below”, “upper” and “lower” are used in the context of the lock cylinder being in its usual orientation.

In one embodiment, the first recess has a depth that is approximately the same size as or slightly larger than the width or diameter of the locking means. In one embodiment, the second recess has a depth that is approximately half the width or diameter of the locking means. In one embodiment, the locking cam is arranged such that when the locking cam is oriented with the first recess being generally aligned with the housing groove, the locking member can move completely out of the housing groove. In another embodiment, the locking cam is arranged such that when the locking cam is oriented with the second recess being generally aligned with the housing groove, the locking member is retained within the housing groove.

In one embodiment, the locking means is located partly within the housing recess and partly within the second recess of the locking cam when the locking means is in the locked position.

In one embodiment, the locking member comprises a bar. The locking member may comprise a generally cylindrical bar. The bar may be oriented so that it is generally parallel to a longitudinal axis of the barrel.

In some embodiments, the locking member does not require use of the spring or other biasing means that acts directly on the locking member to control its movement.

The housing recess may comprise a groove. The groove in the inner wall of the housing may comprise a groove that extends generally parallel to a longitudinal axis of the housing or barrel. The groove may have a cross-sectional shape that is complementary to the cross-sectional shape of the locking member. The groove may have a depth that is approximately half the width or half the diameter of the locking member. The housing groove is sized such that the locking member can be partly received within the housing groove in the locked position, with the locking member also extending into the barrel when in the locked position.

In one embodiment, the lock cylinder further comprises a bearing that bears upon the locking cam, the key having a projection and the projection of the key contacting the bearing during insertion of the key into a key slot to thereby cause rotation of the locking cam. The bearing may comprise a ball bearing. In embodiments where more than one locking cam is used, each locking cam may be provided with this arrangement. Providing a bearing will reduce wear on the key and on the locking cam, thereby increasing the commercial life of the lock and resulting in a more commercially attractive product. However, it will also be appreciated that the lock of the present invention may also be provided without such a ball bearing.

It will be appreciated that the cylinder lock of the present invention will also include the usual pins and tumblers to enable the lock to be locked and unlocked.

In a further embodiment, the lock cylinder of the present invention further includes a blocking cam pivotally mounted within the barrel, the blocking cam including at least one recess on a periphery thereof, the at least one recess including a first recess, the first recess being sized to enable the locking member to move out of the housing groove, the blocking cam being movable between a locking position and an unlocked position, the blocking cam being arranged such that the projection on the key causes the blocking cam to pivot during insertion of the key, wherein the projection on the key includes a recessed region that, when the key is properly inserted, is located in alignment with the blocking cam such that the blocking cam is in the unlocked position, and wherein if a key having a different projection or a lock picking element is inserted into the key slot, the blocking cam is caused to pivot by the projection or the lock picking element so that the blocking cam is moved to the locking position.

When the blocking cam is in the locking position, the blocking cam holds the locking member in the housing groove (which is the locked position) and rotation of the barrel relative to the housing is prevented. In this manner, use of an improper key having a different projection or use of a lock picking element to move the locking cams to the unlocked position will also cause the blocking cam to move to a locked position such that rotation of the barrel relative to the cylinder is prevented. This makes picking the lock much more difficult.

In one embodiment, the blocking cam is biased to an unlocked position.

In this embodiment, it will not be possible to pick the lock by using a standard key having bits that correspond with the pin and tumbler arrangement of the lock and inserting, for example, a piece of wire alongside the key to cause the locking cam to move to a position where the locking member can move to the unlocked position. If this is attempted, the one or more blocking cams will be moved by the piece of wire, thereby causing the one or more blocking cams to lock the barrel against rotation relative to the housing. It is only when a proper key is inserted into the lock that the one or more blocking cams allow the barrel to rotate relative to the lock housing.

In one embodiment, the blocking cam comprises the first recess and a second recess that is shallower than the first recess. The second recess is sized to only partly receive the locking member. In other words, the second recess is smaller in cross-section than a cross section of the locking member. In one embodiment, the first recess and the second recess merge into each other. In one embodiment, both the first recess and the second recess are recessed from an outer periphery of the locking cam. In this embodiment, the locking member may be received in the first recess when the locking member is in the unlocked position and the locking member is received in the second recess when the locking member is in the locked position.

The "lock housing" may also be referred to as the "cylinder housing."

It will be appreciated that the term "lock cylinder" is used to refer to the combination of the barrel and the lock housing. The lock cylinder does not need to be cylindrical in shape. Rather, the term "lock cylinder" is a term of the art that refers to the barrel and the lock housing. In some embodiments, such as in padlocks, the lock housing will form part of the external surface of the lock. This meaning is to be used throughout this specification, including the claims.

In one embodiment, the barrel has a key slot for receiving a key, the key including the projection.

In one embodiment, the lock cylinder is of the pin and tumbler type. The skilled person will appreciate that, in this embodiment, the barrel and the lock housing are provided with aligned bores and that each bore contains a barrel pin and a housing pin. A shear point is located at the junction of the barrel pin and the housing pin in each set of pins. The pins are biased towards the barrel, such as by use of springs. The lock is operated by a key that includes bits that move the housing pin and the locking pin of each set such that the shear point is positioned at the outer diameter of the barrel. When in this position, in an ordinary pin and tumbler lock, as the shear points for each set of pins is located at the outer diameter of the barrel, the barrel can rotate within the lock housing (if the shear points are located at a different position, one of the housing pin or barrel pin will extend across the junction between the barrel and the lock housing and this will jam the barrel against rotation relative to the lock housing). However, in the lock cylinder of the present invention, it is also necessary to ensure that the locking cam(s) be moved to an unlocked position before the barrel can be rotated relative to the lock housing to thereby operate the lock mechanism.

In some embodiments, the key that operates the lock may comprise two or more projections, with each projection moving a locking cam. The two or more projections may project from the same side of the key, or they may project from opposing sides of the key.

In one embodiment, a slot is formed in the barrel and the locking cam is mounted in the slot. The slot may extend transversely to a longitudinal direction of the barrel. The locking cam may be mounted to a pivot pin extending through an opening in the locking cam. The pivot pin may be located in a bore in the barrel. The pivot pin may be located in a bore that extends in a direction generally parallel to a longitudinal axis of the barrel. This bore suitably extends inwardly from a rear surface of the barrel.

In embodiments where the lock includes a blocking cam, the blocking cam may be mounted by a pivot pin extending through an opening in the blocking cam. The blocking cam may be mounted in a slot formed in the barrel. The slot may comprise a transverse slot.

The transverse slots formed in the barrel may extend only part way into the barrel.

Throughout this specification the term "front of the barrel" is used to denote the end of the barrel where the opening to the key slot can be seen and the term "rear of the barrel" is used to denote the end of the barrel that is positioned in the lock housing and not accessible from the outside of the lock.

In some embodiments, the key slot is provided with an opening for receiving a key having a projection with a contact surface for contacting the locking cam to thereby cause the locking cam to move to a position where the locking member moves to the unlocked position. In one embodiment, the key has a laterally extending projection that causes the locking cam to allow the locking member to move out of the housing groove on the lock housing. The laterally extending projection may be in the form of a wing extending from a side of a shank of the key. In some embodiments, it will be appreciated that the contact surface of the key comes into contact with a drive member that, in turn, drives operation of the locking cam to drive the locking cam to a position where the locking member moves to the unlocked position. In some embodiments, the key may have two or more laterally extending projections.

In some embodiments, the key for actuating the lock cylinder includes bits for moving the sets of barrel pins and housing pins in a first direction and the projection for moving the locking cam comprises a projection extending in a different direction to the first direction. In one embodiment, the projection for moving the locking cam comprises a projection extending at right angles to the first direction. In one embodiment, the key moves the sets of pins in a generally vertical direction and the projection extends in a generally horizontal direction.

In embodiments of the present invention, the special profile of the key with the side projection is designed to operate the locking cam in the barrel so that it moves to a position that allows the locking member to move to the unlocked position and permits the barrel to turn. A lock system can be designed to have a current standard profile key that will only operate some cylinders in the system that do not have the locking cam and locking member installed into the barrel, whilst the special profile keys can work most or all cylinders in the system as required. For example, in a unit complex, each unit occupant may be provided with a standard profile key that can operate a front access gate to the unit complex and the front door to an occupant's unit. However, there may be other areas to which the occupants of the units are not allowed access, such as an enclosure housing electrical components. The locks used on the enclosure housing electrical components can be in accordance with the present invention and the superintendent (and possibly employees of the electricity supply company) can be provided with special profile keys to enable them to have access to the enclosure. In this system, it will be appreciated that the key slots of all of the barrels and the system will have openings that enable keys having projections to be inserted therein, even if the particular lock does not include the locking cam and locking member in the barrel. In this manner, the special profile key of the superintendent can be inserted into all locks in the system.

Embodiments of the present invention enable the locksmith to produce for the system owner (A) lock products and keys, and that the end user can also source additional products and have those products become an extended part of their own lock system with (B) two or more levels of restricted and unrestricted keys for issue to provide access to their property. A lock system using this product can include locks and keys on a property on level 1 keys, being non-restricted keys where the end user or person can source additional keys without signatory control, and other locks on the same property on level 2 keys, being restricted and controlled issue keys for access, that are only available from the originating manufacturer locksmith of the system with a recorded signatory order. The present invention can also provide a system with a mix of lock cylinder/s incorporated into the system that would function on system (B) restricted keys as well as with areas or parts of the system of non-restricted key access, whilst also providing special access to designated locks or areas functioning on the system (A) key.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Various embodiments of the invention will be described with reference to the following drawings, in which:

FIG. 6 shows a front cross sectional view of a lock cylinder in accordance with the present invention, with a blocking cam being shown in an unlocked position;

FIG. 7 shows a front cross sectional view that is similar to that shown in FIG. 6, but with the blocking cam in a locked position; and FIG. 8 shows an enlarged view of the lock barrel and blocking cam as shown in FIG. 6.

DESCRIPTION OF EMBODIMENTS

It will be appreciated that the drawings have been provided for the purposes of illustrating preferred embodiments of the present invention. Therefore, it will be understood that the present invention should not be considered to be limited solely to the features as shown in the attached drawings.

Figure 1:
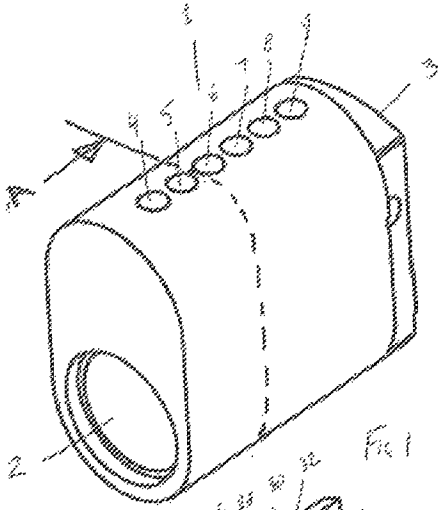
FIG. 1 shows a perspective view of a lock housing in accordance with an embodiment of the present invention.

FIG. 1 shows a lock housing 1. The lock cylinder 1 has a bore 2 formed therein and a lock barrel 14 (see FIG. 2) is fitted into the bore 2 in the lock housing 1. A locking mechanism, generally denoted at 3, is actuated by rotation of the barrel 14. The locking mechanism may be of conventional design and need not be described further. The skilled person will appreciate that the locking mechanism 3 operates a latch, a locking bolt or the like which is used to lock a door or a gate, etc. As can be seen from FIG. 2, the barrel 14 includes a key slot 18. The key slot 18 has an opening in the front face 19 of the barrel 14.

Figure 3:
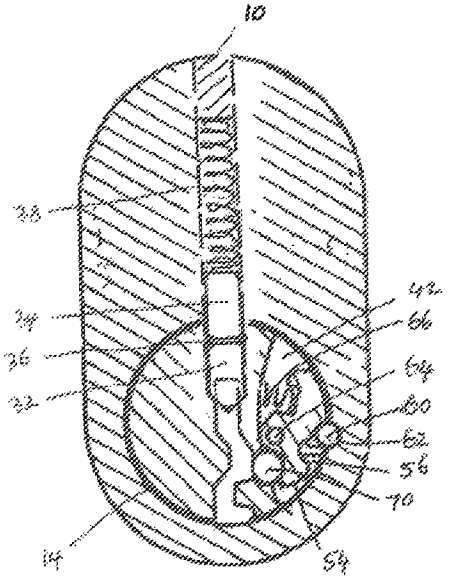
FIG. 3 shows a front cross sectional view of a lock cylinder in accordance with the present invention, with a locking cam being shown in a locked position.
Figure 2:
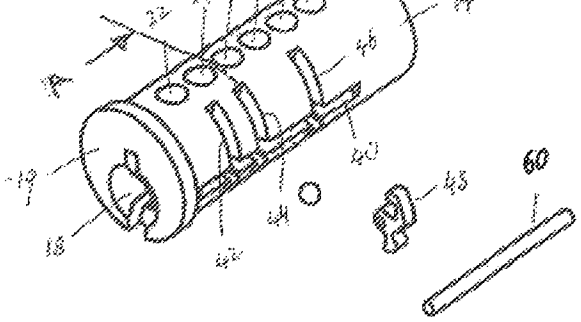
FIG. 2 shows a perspective view of a lock barrel in accordance with one embodiment of the present invention.

The barrel 14 is shown in FIG. 2. The barrel 14 includes six spaced bores 20, 22, 24, 26, 28, 30. These bores come into alignment with a corresponding series of six bores 4, 5, 6, 7, 8, 9 that are formed in the lock housing 1 (as shown in FIG. 3). The upper ends of the bores 4-9 in the housing 1 are closed by appropriate plugs, one of which is shown at 10 in FIG. 3.

The bores each hold a bore pin 32 and a housing pin 34. A shear junction or shear point 36 exists at the point of contact between the bore pin 32 and the housing pin 34. A spring 38 biases the pins 32, 34 inwardly towards the bore 14. This arrangement of bores and pins is conventional in pin and tumbler locks and it need not be described further.

The barrel 14 shown in FIG. 2 includes a longitudinal slot 40 machined into one side of the barrel to accommodate the locking member 60. A plurality of transverse extending slots (in this case, 3 transverse slots) 42, 44, 46 are also machined into the barrel 14, with the transverse slots 42, 44, 46 intersecting the longitudinal slot 40. Locking cams, one of which is shown at 48, are inserted into two of the transverse slots 44, 46. A blocking cam is inserted into the remaining transverse slot 42. A locking member 60, in the form of a cylindrical bar 60, is also positioned in the longitudinal slot 40.

Although not shown in FIG. 2, a bore is drilled into the barrel 14 from the rear face of the barrel towards the front face of the barrel. A pivot pin is inserted through this bore and the pivot pin is used to pivotally mount the locking cams and blocking cam in their respective transverse slots. This will be described in more detail hereunder.

Figure 4:
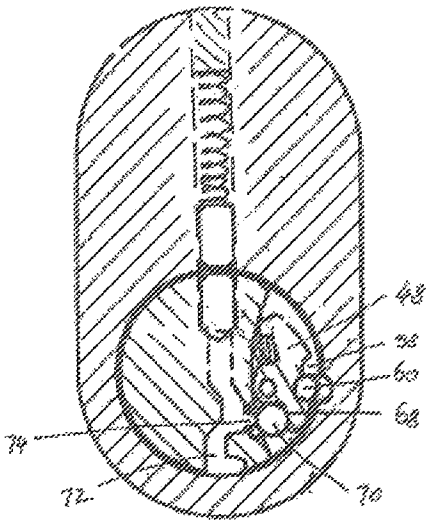
FIG. 4 shows a front cross sectional view that is similar to that shown in FIG. 3, but with the locking cam in an unlocked position.
Figure 5:
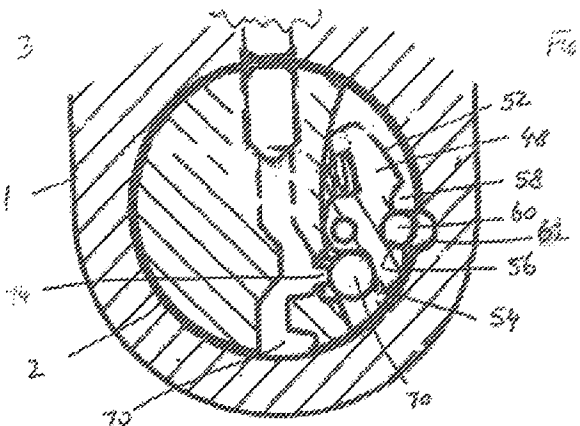
FIG. 5 is an enlarged view of the lock barrel and locking cam as shown in FIG. 4.

FIGS. 3 to 5 show a cross sectional view taken along line A in FIGS. 1 and 2. FIG. 3 shows the locking cam being in a locked position whilst FIGS. 4 and 5 show the locking cam in the unlocked position.

As best shown in FIG. 5, locking cam 48 has a first peripheral surface 52 and a second peripheral surface 54. A first recess 56 and a second recess 58 are located between the first peripheral surface 52 and the second peripheral surface 54. As can be seen from FIGS. 3 to 5, the first recess 56 is significantly deeper than the second recess 58. As a result, a locking member, in the form of a cylindrical bar 60, can be fully received in the first recess 56.

The inner wall of the bore 2 of the housing 1 has a housing recess 62 in the form of a groove machined into the inner wall of the bore 2. The cylindrical groove 62 has a diameter that is just slightly larger than the diameter of cylindrical bar 60 such that about half of the cylindrical bar 60 can fit into the cylindrical groove 62.

The second recess 58 of the locking cam 48 is significantly less deep than the first recess 56. As a result, although the second recess has a surface that is complementary to the surface of the cylindrical bar 60, when the cylindrical bar 60 is received in the second recess 58, the cylindrical bar 60 protrudes out of the second recess 58 to a large extent. In this manner, when the second recess is in alignment with the housing groove 62, the cylindrical bar 60 extends from the second recess 58 into the housing groove 62.

The locking cam 48 also includes an opening 64 through which a pivot pin can extend. A biasing spring 66 biases the locking cam in a clockwise direction (as shown with reference to the orientation shown in FIGS. 3 to 5), such that the first peripheral surface 52 is biased towards the wall of the bore 2. The locking cam 48 also includes a lower inner surface 68 that is in contact with a ball bearing 70. Due to the locking cam 48 being biased by spring 66 in a clockwise direction, the surface 68 of the locking cam 48 remains in contact with the ball bearing 70.

FIG. 3 shows the locking cam 48 in a locked position, in which the barrel is locked against rotation relative to the housing. As shown in FIG. 3, the locking member/cylindrical bar 60 is seated in housing recess/cylindrical groove 62. The locking member 60 is also seated in the second recess 58. As a result, the locking member 60 prevents rotation of the barrel relative to the housing.

FIGS. 4 and 5 show insertion of a key 72 having a wing 74 extending laterally from the shank. When the key 72 is inserted into the key slot of the barrel, the wing 74 comes into contact with the ball bearing 70 and drives the ball bearing 70 to the right (as shown in FIG. 4). This causes the locking cam 48 to pivot about the pivot pin extending through opening 64. As a result, the locking cam 48 rotates in an anticlockwise direction. This moves the locking cam 48 such that the deeper first recess 56 comes into alignment with the locking member 60. Due to the larger depth of the first recess 56, the locking member 60 can move into the first recess 60 and move out of the housing recess 62. This is shown in FIGS. 4 and 5. As a result of this movement, the locking member 60 no longer interacts with the locking groove 62 and the locking member 60 no longer locks the barrel 14 against rotation relative to the housing 1. Consequently, the key (which is also operating the pins 32, 34) can be turned to cause the barrel 14 to also turn.

When the key 70 is removed from the key slot, the wing 74 is no longer acting on the ball bearing 70. As a result, the spring 66 causes the locking cam 48 to rotate in a clockwise direction, which brings the shallow second recess 58 back into contact with the locking member 60. As the locking cam 48 rotates in a clockwise direction as the key is pulled out, the lower edge of the housing recess 62 contacts the locking member 60 and stops further downward movement of the locking member 60. Continued rotation of the locking cam in a clockwise direction brings the second recess 58 adjacent to the locking bar 60 and this physically retains the locking bar 60 in the space defined by the housing groove 62 and the second recess 58. This stops relative rotation between the barrel 14 and the housing 1. The locking cam 48 reverts to the orientation shown in FIG. 3 when the key 70 is withdrawn.

In order to avoid the possibility of having someone with a key that operates the pins 32, 34 but without a wing 72 from also operating the lock by inserting a piece of wire or a lock picking element adjacent to the key to force the locking cam to move to the orientation shown in FIGS. 4 and 5, the barrel 14 may also be provided with one or more blocking cams, as shown in FIGS. 6 to 8. The blocking cam 80 includes a first peripheral surface 82 and a second peripheral surface 84. The blocking cam 82 also includes a first recess 86 and a second recess 88. Unlike the locking cam, in which the first recess 56 is located below the second recess 58, in the blocking cam 80, the first recess 86 is located above the second recess 88. Apart from this difference, the blocking cam 80 is similar to the locking cam 48. The blocking cam 80 is also pivotally mounted in the barrel 14 about a pivot pin that extends through opening 90 and a biasing spring 92 biases the blocking cam in a clockwise direction. A ball bearing 94 contacts a lower surface of the blocking cam 80 and the key 70.

In order to operate a lock having the blocking cam arrangement shown in FIGS. 6 to 8, it is necessary to use a key that has a laterally extending wing 74 that also has recesses cut into the laterally extending wing at a position where the ball bearing 94 or blocking cam 80 is located.

FIG. 7 shows the blocking cam 80 in a locked position. If a key having a lateral wing 74 that does not have a correctly positioned recess is inserted into the key slot of the barrel 14, the wing 74 causes the blocking cam 80 to rotate in an anticlockwise direction, which brings the shallow second recess 88 into alignment with the locking bar 60 and the housing groove 62. As a result, the locking member 60 is physically held between the housing groove 62 and the first recess 88. This locks the barrel 14 against rotation relative to the housing 1. It will be appreciated that the blocking cam will also be pushed into a locked position if a piece of wire or a lock picking element is inserted alongside a key if an attempt was made to pick the lock.

If the key with a properly cut recess in the wing 72 is used, the wing does not act on the ball bearing 94 and the biasing spring 92 biases the blocking cam 80 in a clockwise direction to the position shown in FIGS. 6 and 8. In this position, the deeper first recess 86 is in alignment with the locking member 60, which enables the locking member 60 to move out of the housing recess 62. As a result, the locking member 60 no longer locks the barrel 14 against rotation relative to the housing 1.

The key 70 may be provided with one or more recesses in the projection 72 in a manner that is similar to that as shown in FIG. 8 of Australian patent number 666369.

In the embodiment shown in the attached figures, the barrel 14 is fitted with two locking cams and one blocking cam. It will be appreciated that the number of locking cams and blocking cams may vary. Further, the position of the locking cams and blocking cams may also vary. In one embodiment, the locking cams are positioned in slots 42 and 46 and the blocking cam in slot 44. In another embodiment, the locking cams are positioned in slots 42 and 44 and the blocking cam in slot 46. In another embodiment the locking cams are positioned in slots 44 and 46 and the blocking cam is positioned in slot 42.

In embodiments of the present invention, the locking cams are biased to the locked position and the blocking cams are biased to the unlocked position.

The lock cylinder of the present invention provides a lock cylinder of enhanced security. The lock cylinder is desirably suitable for use with a C4 key or similar profile having an additional lateral projection or wing extending along a side thereof. In some embodiments, locking arms may provided on both sides of the key slot and the key maybe provided with projections or wings on both sides of the key shank. The key slot suitably includes an opening that is of complementary shape to keys having the desired projections or wings thereon. The lock cylinder may be provided with one or more locking cams. In the embodiment shown in the attached figures, the lock cylinder is provided with two locking cams.

Locks cylinders in accordance with the present invention allow lock systems to be implemented in which some locks have lock cylinders in accordance with the present invention and other locks have lock cylinders without the locking cams. In such systems, a superintendent may have a restricted key with the lateral projection or wing in order to provide master key access to a number of locks. However, an occupant may be provided with a lock that does not have a locking cam and a non-restricted key that does not include the lateral projection or wing. The occupant's key can operate, for example, the front door of the unit that is equipped with a lock without the locking cams. However, the occupants key cannot operate a secure lock that is fitted with the locking cams, such as a lock fitted to an enclosure housing electrical meters or equipment. However, the superintendent will have a key that has the projection or wing and this enables the superintendent to operate both the lock to the occupant's unit and the lock to the enclosure housing electrical meters or equipment.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A lock cylinder comprising:

a barrel having a locking cam pivotally mounted therein, the locking cam including at least one recess on an outer periphery thereof, and an opening or a hole through which a mounting pin extends such that the locking cam pivots about the mounting pin;

a lock housing including a housing recess formed on an inner wall of the lock housing;

a bearing that bears upon the locking cam; and a locking member that, in a locking position, is positioned at least partly in the housing recess formed on the inner wall of the lock housing;

wherein the at least one recess on the locking cam including a first recess on the locking cam, the first recess being sized to enable the locking member to move out of the housing recess;

wherein the barrel having a key slot for receiving a key, the key including a projection, the bearing being configured for contacting with the projection of the key to thereby cause the locking cam to rotate to bring the first recess on the locking cam adjacent to or into alignment with the locking member such that the locking member moves out of the housing recess and into the first recess of the locking cam to thereby enable rotation of the barrel in the lock housing.

2. The lock cylinder of claim 1, wherein the locking cam is biased towards the locking position.

3. The lock cylinder of claim 2 further comprising a biasing means located between the locking cam and an inner part of the barrel.

4. The lock cylinder of claim 1, wherein the locking cam comprises the first recess and a second recess that is shallower than the first recess such that the second recess is sized to only partly receive the locking member.

5. The lock cylinder of claim 4, wherein the first recess is larger than the second recess on the locking cam and the first recess is located below the second recess.

6. The lock cylinder of claim 5, wherein the locking cam is arranged such that when the locking cam is oriented with the second recess being generally aligned with the housing recess, the locking member is retained within the housing recess.

7. The lock cylinder of claim 6, wherein the locking member is located partly within the housing recess and partly within the second recess of the locking cam when the locking member is in the locked position.

8. The lock cylinder of claim 1, wherein the locking member comprises a bar and the housing recess comprises a groove that extends generally parallel to a longitudinal axis of the housing or barrel.

9. The lock cylinder of claim 1, wherein the projection of the key contacts the bearing during insertion of the key into the key slot to thereby cause rotation of the locking cam.

10. The lock cylinder of claim 9, wherein the bearing is a ball bearing.

11. The lock cylinder of claim 1 further comprising a blocking cam pivotally mounted within the barrel, the blocking cam including at least one blocking cam recess on a periphery thereof, the at least one blocking cam recess including a first blocking cam recess, the first blocking cam recess being sized to enable the locking member to move out of the housing groove, the blocking cam being movable between a blocking cam locking position and an blocking cam unlocked position, the blocking cam being arranged such that the projection on the key causes the blocking cam to pivot or rotate during insertion of the key, wherein the projection on the key includes a recessed region that, when the key is properly inserted, is located in alignment with the blocking cam such that the blocking cam is in the blocking cam unlocked position, and wherein if a key having a different projection or a lock picking element is inserted into the key slot, the blocking cam is caused to pivot by the projection or the lock picking element so that the blocking cam is moved to the blocking cam locking position.

12. The lock cylinder of claim 11, wherein the blocking cam is biased to the blocking cam unlocked position.

13. The lock cylinder of claim 11, wherein the blocking cam comprises the blocking cam first recess and a blocking cam second recess that is shallower than the blocking cam first recess such that the second recess is sized to only partly receive the locking member.

14. The lock cylinder of claim 11, wherein the blocking cam first recess is located above the blocking cam second recess in the blocking cam.

15. The lock cylinder of claim 11, wherein the blocking cam is mounted by a pivot pin extending through an opening in the blocking cam.

16. The lock cylinder of claim 11, wherein the blocking cam is mounted in a transverse slot formed in the barrel and the locking cam is mounted in a transverse slot formed in the barrel.

17. The lock cylinder of claim 11, wherein the barrel is provided with a longitudinal slot to accommodate the locking member when the locking cam and the blocking cam are in the unlocked position.

18. The lock cylinder of claim 1, wherein the projection comprises a lateral projection or a wing on the key.

19. The lock cylinder of claim 1, wherein the lock cylinder comprises a plurality of locking cams.

20. The lock cylinder of claim 1, wherein the lock cylinder is of the pin and tumbler type.

* * * * *